US006124247A

United States Patent [19]

Cazin et al.

[11] Patent Number: 6,124,247

[45] Date of Patent: Sep. 26, 2000

[54] USE OF BORATED COMPOUNDS FOR THE IMPROVEMENT OF THE COMPATIBILITY OF LUBRICATING OILS WITH FLUOROCARBON ELASTOMERS

[75] Inventors: Jacques Cazin, Saint Martin du Manoir; Pierre Tequi, Saint-Romaint de Colbosc, both of France; William M. Kleiser, Lafayette, Calif.; Peter Kleijwegt, Heinenoord, Netherlands

[73] Assignee: Chevron Chemical S.A., France

[21] Appl. No.: 09/389,303

[22] Filed: Sep. 2, 1999

Related U.S. Application Data

[63] Continuation of application No. 09/065,002, Apr. 23, 1998, abandoned.

[30] Foreign Application Priority Data

May 5, 1997 [FR] France ..... 97 05512

[51] Int. Cl.[7] ..... C10M 141/12

[52] U.S. Cl. ..... 508/198; 508/197; 508/291

[58] Field of Search ..... 508/198, 197, 508/291

[56] References Cited

U.S. PATENT DOCUMENTS

| | | | |
|---|---|---|---|
| 4,455,243 | 6/1984 | Liston | 508/192 |
| 4,495,088 | 1/1985 | Liston | 508/198 |
| 5,006,272 | 4/1991 | Andress et al. | 252/49.6 |
| 5,356,552 | 10/1994 | Harrison et al. | 252/51.5 A |

FOREIGN PATENT DOCUMENTS

| | | | |
|---|---|---|---|
| 0 136 185 | 4/1985 | European Pat. Off. | C10M 133/56 |
| 0 758 016 | 2/1997 | European Pat. Off. | C10M 133/00 |
| 2 102 023 | 1/1983 | United Kingdom | C10M 1/54 |
| 93/07242 | 4/1993 | WIPO | C10M 141/06 |

*Primary Examiner*—Jerry D. Johnson
*Attorney, Agent, or Firm*—W. K. Turner; R. J. Sheridan

[57] ABSTRACT

The invention relates to the use of an effective quantity of borated compounds having the following general formula I:

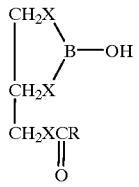

in which X is S or O, and R is a hydrocarbyl group containing at least 3 carbon atoms, in particular between 3 and 50 carbon atoms and preferably between 3 and 17 carbon atoms, as an additive improving the compatibility of a lubricating oil composition, comprising dispersants containing basic nitrogen atoms, with fluorocarbon elastomers. In a preferred fashion, the compound of general formula I is borated glycerol monooleate and the concentration of the compound of general formula I is such that the % Boron/% basic N ratio of the lubricating composition varies from 0.25 to 5.

4 Claims, No Drawings

USE OF BORATED COMPOUNDS FOR THE IMPROVEMENT OF THE COMPATIBILITY OF LUBRICATING OILS WITH FLUOROCARBON ELASTOMERS

This application is a continuation of U.S. Ser. No. 09/065,002 filed on Apr. 23, 1998, now abandoned which claimed priority under 35 U.S.C. §119 based upon French Patent Application No. 9705512 filed on May 5, 1997.

The present invention relates to the improvement of the compatibility of a lubricating oil composition comprising dispersants, containing basic nitrogen atoms, with fluorocarbon elastomer seals.

BACKGROUND OF THE INVENTION

Lubricating oil compositions, in particular for the automotive industry, make use of a large number of additives, each having its respective role.

Among the most important additives are dispersants, which, as their name indicates, are used to guarantee engine cleanliness and to keep carbonate residues in suspension.

The most widely used dispersants today are products of the reaction of succinic anhydrides substituted in alpha position by an alkyl chain of polyisobutylene (PIBSA) type with a polyalkylene amine, optionally post-treated with a boron derivative, ethylene carbonate or other post-treatment reagents known in the specialized literature.

Among the polyamines used, polyalkylene-amines are preferred, such as diethylene triamine (DETA), triethylene tetramine (TETA), tetraethylene pentamine (TEPA), pentaethylene hexamine (PEHA) and heavier poly-alkylene-amines (HPA).

These polyalkylene amines react with the succinic anhydrides substituted by alkyl groups of polyisobutylene (PIBSA) type to produce, according to the molar ratio of these two reagents, mono-succinimides, bis-succinimides or mixtures of mono- and bis-succinimides Such reaction products, optionally post-treated, generally have a non-zero basic nitrogen content of the order of 5 to 50, as measured by the total base number or TBN, expressed as mg of KOH per gram of sample, which enables them to protect the metallic parts of an engine while in service from corrosion by acidic components originating from the oxidation of the lubricating oil or the fuel, while keeping the said oxidation products dispersed in the lubricating oil to prevent their agglomeration and their deposition in the casing containing the lubricating oil composition.

These dispersants of mono-succinimide or bis-succinimide type are even more effective if their relative basic nitrogen content is high, i.e. in so far as the number of nitrogen atoms of the polyamine is larger than the number of succinic anhydride groups substituted by a polyisobutenyl group.

However, the higher the basic nitrogen content of these dispersants, the more they favour the attack of the fluorocarbon elastomer seals used in modern engines, because the basic nitrogen tends to react with the acidic hydrogen atoms of this type of seal, and this attack results in the formation of cracks in the elastomer surface and the loss of other physical properties sought in this type of material.

In order to resolve this dilemma, it has been proposed, according to U.S. Pat. No. 5,326,552 filed by the company Chevron, to subject the dispersants of bis-succinimide type to a post-treatment by reaction with a cyclic carbonate. Such a process not only improves the sludge dispersion in a lubricating oil containing these additives, but also the compatibility of the oil with a fluorocarbon elastomer.

Another solution is the subject of a Patent Application WO 93/07242, also filed by Chevron, in which the compatibility of a lubricating oil comprising additives containing basic nitrogen atoms with fluorocarbon elastomers is guaranteed by the addition of borated aromatic polyols, such as borated alkyl catechols.

Furthermore, it is well known that, in order to meet the longevity requirements demanded today in internal combustion engines, the lubricating oil compositions must contain a great number of other ingredients, each of which has a very specific role.

Accordingly, besides the dispersants of the preceding type, other detergents are added, such as sulphonates, alkylphenates or metallic salicylates, sulphurized or not, antioxidants, in particular zinc dialkyl dithiophosphates, extreme pressure agents, foam inhibitors, friction reducers, rust removing agents, corrosion inhibitors, pour point depressants, viscosity improvers and many other additives.

Among the additives thus used as agents to reduce friction between moving surfaces in engines are borated glycerol or thio-glycerol esters.

SUMMARY OF THE INVENTION

The present invention is based upon the discovery that, by using lubricating oil compositions containing a dispersant of mono-succinimide or bis-succinimide type, post-treated or not, in combination with a borated glycerol ester, one obtains a composition compatible with fluorocarbon elastomers.

This combination effect in a lubricating oil is especially surprising because each of these additives has a very specific function, namely the maintenance of sludge in suspension for the first, and friction reduction for the second, and that an additional effect, probably linked to the interaction of the first additive with the second, does not harm their own function but allows this unexpected additional effect of compatibility with fluorocarbon elastomers to be obtained.

In this new use, the borated glycerol ester is preferably an ester of a carboxylic acid, in particular a fatty acid, saturated or unsaturated, containing only one carboxylic acid function, such as, for example, palmitic, stearic and oleic acids. Among these compounds, borated glycerol mono-oleate is preferred.

The invention thus relates to the use of an effective quantity of borated compounds having the following general formula:

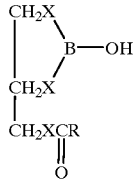

in which X is S or O, and R is a lipophilic hydrocarbyl group allowing the solubilization of the substance, this hydrocarbyl containing at least 3 carbon atoms, in particular between 3 and 50 carbon atoms and preferably between 3 and 17 carbon atoms, as an additive improving the compatibility of a lubricating oil composition, comprising dispersants containing basic nitrogen atoms, with fluorocarbon elastomer seals.

In general, the borated glycerol esters, which are preferably mono-esters, are mixed with other additives, in particular with detergent/dispersant additives of succinimide type and added to the lubricating oil composition in proportions such that the ratio % Boron/% basic N of the dispersants varies from 0.25 to 5. However, ranges of more precise values can be selected from this general range in order to account for the exact nature of the nitrogen dispersant additives, generally dispersants of polyalkylene succinimide type. This determination, once the property of the borated glycerol esters to protect the fluorocarbon elastomers is known, can be made by a person skilled in the art by tests that are easy to perform.

DETAILED DESCRIPTION OF THE INVENTION

By way of example, it should be noted that one of these tests is the PV 3344 static immersion test developed by the manufacturer Volkswagen to evaluate the chemical attack of lubricating oils on Viton TN type fluorocarbon elastomers. Amongst other things, this test measures the formation of surface cracks on these elastomers after immersion for 282 hours in the oil proposed.

Without wishing to restrict themselves to the additives mentioned hereafter, the inventors have observed that the ratio % Boron/% basic N of the dispersants, allowing the formation of surface cracks in fluorocarbon elastomers to be avoided for an additive containing bis-succinimides, varied substantially depending on whether or not the bis-succinimide had been subjected to a post-treatment step. For example, if the additive contains borated glycerol mono-oleate as well as a polyalkylene bis-succinimide which has undergone post-treatment with ethylene carbonate, the minimum ratio % Boron/% basic N of the dispersants used to reduce the surface cracks of the fluorocarbon seals is about 1.0. On the other hand, if the additive contains an untreated bis-succinimide, the minimum ratio % Boron/% basic N, of the dispersants, is situated at about 3. The choice of the minimum ratio % Boron/% basic N is determined by the structural environment of the nitrogen atoms present in the dispersant additive, more precisely by the hindrance around these nitrogen atoms, which makes them more or less accessible to the borated glycerol esters used to neutralize their attack on the fluorocarbon esters.

The concentration of basic nitrogen in % by weight in the oil is calculated using the following equation:

% basic N=BN/40 of the×concentration in % weight polyisobutylene of the polyisobutylene bis-succinimide bis-succinimide in the oil The BN of the polyisobutylene bis-succinimide is measured by the ASTM D 2896 method.

The boron concentration, given in % by weight in the oil, is calculated using the following equation:

% boron=% boron of the base ester×concentration by weight of the boron ester in the oil The % boron in the boron ester is measured by the plasma emission spectroscopy (ICP) method described below:

The results are obtained under the following conditions

ARL 3580 spectrometer under vacuum—750W—Meinhard type K minitroch nebulizer=temperature-controlled nebulization chamber at 5° C. with jet breaker.

observation height: 9 mm above the turn.

argon flow rates:

carrier 0.65 l/min.

plasma 0.8 l/min.

coolant 11 l/min.

Rays observed : for boron: 182.64 mm; for selenium internal standard: 196.09 mm.

Calibration range 0 to 50 ppm (at torch), standards prepared using CONOSTANT BORON 5000 ppm. The internal standard is introduced at a concentration of 100 ppm (at torch). The standards and samples are diluted in kerosene. Sample rate: 2 to 2.5 ml/min. regulated by a peristaltic pump.

The choice as well as the concentration of the appropriate borated glycerol ester is determined by considering the type of dispersant, in particular of mono- or bis-succinimide type. A person skilled in the art can use several methods to make the appropriate choice.

The invention also relates to the use of mixtures of borated glycerol esters. In fact, it is advisable in certain situations to select mixtures, particularly if the additive comprises a plurality of dispersants of alkyl or alkenyl mono- or bis-succinimide type. The proportion of different glycerol borated esters is then directly related to the proportion of the different dispersants. By way of example, bis-succinimides with a molecular weight of 500 to 5000 and mono-succinimides with a molecular weight of 500 to 5000, post-treated or not with ethylene carbonate, react well with borated glycerol mono-oleate. The concentration of borated glycerol ester must then be adjusted as a function of the post-treatment to which the dispersant may optionally be subjected.

Among the borated glycerol or thioglycerol esters used for the synthesis of borated esters there can be mentioned amongst others, glycerol mono-oleate, glycerol mono-ricinoleate, glycerol laurates, myristates, palmitates and stearates, phenyl stearates as well as their unsaturated derivatives. It is also possible to use thioglycerol esters. By way of example, there can be mentioned monothioglycerol or dithioglycerol mono-oleate and also trithioglycerol mono-oleate.

The borated glycerol esters can be prepared by reacting a glycerol ester with boric acid in an appropriate solvent at a temperature which can vary between 90 and 280° C. The experimental parameters as well as the molar proportions of the different reagents are well known. It is also possible to adjust the degree of boration of the glycerol esters as a function of the property desired. Boration as complete as possible is generally sought. The boration reaction is obviously not limited to the use of boric acid. Other boration methods, such as transesterification using a borated alkyl, are also known to the person skilled in the art.

The oil soluble alkenyl or alkyl mono- or bis-succinimides which are used in the present invention are generally known as lubricating oil dispersants and are described in U.S. Pat. Nos. 2,992,708, 3,018,291, 3,024,237, 3,100,673, 3,219,666, 3,172,892 and 3,272,746, the descriptions of which are incorporated herein by way of reference. The alkenyl succinimides are the reaction product of a succinic anhydride substituted by a polyolefin polymer with an amine, preferably a polyalkylene polyamine. The polyolefin polymer-substituted succinic anhydrides are obtained by the reaction of a polyolefin polymer or one of its derivatives with maleic anhydride. The succinic anhydride thus obtained is reacted with the amine. The preparation of the alkenyl succinimides has been described many times in the art. See, for example, U.S. Pat. Nos. 3,390,082, 3,219, 666 and 3,172,892, the descriptions of which are incorporated herein by way of reference. Reduction of the alkenyl substituted succinic anhydride produces the corresponding alkyl derivative. A product comprising predominantly mono- or bis-succinimide can be prepared by adjusting the molar ratios of the reactants. Thus, for example, if one mole of amine is reacted with one mole of the succinic anhydride substituted by alkenyl or alkyl, a predominantly mono-succinimide product will be prepared. If two moles of the succinic anhydride are reacted per mole of polyamine, a bis-succinimide will be prepared.

Particularly advantageous results with the lubricating oil compositions of the present invention are obtained when the alkenyl succinimide is a mono- or a bis-succinimide prepared from a succinic anhydride substituted by polyisobutene of a polyalkylene polyamine.

The polyisobutene (from which the polyisobutene-substituted succinic anhydride (PIBSA) is prepared) is obtained by the polymerization of isobutene and can vary widely in its composition. The average number of carbon atoms can range from 30 to a value of greater than or equal to 250, with a resulting number average molecular weight comprised in the range of a value less than or equal to about 400 to a value equal to or greater than 3500. Preferably, the average number of carbon atoms per polyisobutene molecule will range from about 50 to about 180, the polyisobutene having a number average molecular weight of about 700 to about 2500. More advantageously, the average number of carbon atoms per polyisobutene molecule ranges from about 85 to about 180 and the number average molecular weight ranges from about 1200 to 2500. The polyisobutene is reacted with maleic anhydride according to well-known operating methods in order to obtain the polyisobutene-substituted succinic anhydride. See, for example, U.S. Pat. Nos. 4,388,471 and 4,450,281.

In the preparation of the alkenyl succinimide, the substituted succinic anhydride is reacted with a polyalkyleneamine to produce the corresponding succinimide. Each alkylene radical of the polyalkyleneamine usually has up to about 8 carbon atoms. The number of alkylene radicals can range up to about 8. The alkylene radical is illustrated by ethylene, propylene, butylene, trimethylene, tetramethylene, pentamethylene, hexamethylene, octamethylene, etc. The number of amino groups is generally greater than the number of alkylene radicals present in the amine, i.e. if a polyalkyleneamine contains three alkylene radicals, it will usually contain about 4 amino radicals. The number of amino radicals can range up to about 9. Preferably, the alkylene radical contains from about 2 to about 4 carbon atoms and all the amine groups are primary or secondary groups. It is generally preferred that the polyalkyleneamine/PIBSA ratios have a value contained in the range between 0.3 and 0.7, with values of about 0.4 to 0.5 being particularly preferred.

Preferably the polyalkyleneamine contains from 2 to 6 amine groups. Specific examples of the polyalkyleneamines include ethylenediamine, diethylenetriamine, triethylenetetramine, propylenediamine, tripropylenetetramine, tetraethylenepentamine, trimethylenediamine, pentaethylenehexamine, di-(trimethylene)triamine, tri(hexamethylene)tetramine, etc.

Other amines suitable for the preparation of the alkenyl succinimides which are of use in this invention include the cyclic amines such as piperazine, morpholine and the dipiperazines.

Preferably the alkenyl succinimides used in the compositions of the present invention have the following formula:

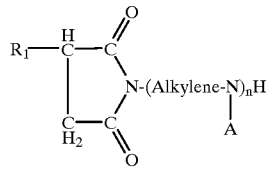

in which:

$R_1$ represents an alkenyl group, preferably a substantially saturated hydrocarbon group prepared by the polymerization of aliphatic monoolefins and preferably $R_1$ is prepared from isobutene and has an average number of carbon atoms and a number average molecular weight as defined previously;

the "alkylene" radical represents a substantially straight chain hydrocarbyl group containing up to about 8 carbon atoms and preferably containing from about 2 to 4 carbon atoms as defined previously;

"A" represents a hydrocarbyl group, an amine-substituted hydrocarbyl group, or hydrogen; the hydrocarbyl group and the amine-substituted hydrocarbyl groups are generally the alkyl and amino substituted alkyl analogs of the alkylene radicals described above; and preferably "A" represents hydrogen; and n represents an integer of from about 1 to 10, and preferably from about 3 to 5 inclusive.

The alkenyl succinimide is present in the lubricating oil compositions which are of use in this invention in a sufficient quantity to impart the desired dispersant properties to the lubricating oil in order to prevent the deposit of contaminants formed in oil during operation of the engine. In general, the percentage by weight of succinimide is contained in the range from 1 to 20% by weight of the finished lubricating oil, usually from 2 to 15% by weight and preferably from 1 to 10% by weight of the total composition.

The alkenyl succinimides used in the context of the present invention can also be subjected to post-treatment reactions with compounds such as ethylene carbonate. These treatments are well known to a person skilled in the art (see, for example, U.S. Pat. No. 4,904,278 by Timothy Erdman).

The addition of the borated glycerol esters described above to the alkenyl succinimide results in the formation of a complex with the succinimide.

The exact structure of the complex of the present invention is not known for certain. However, without wishing to limit the present invention to any theory, it is considered that this complex consists of compounds in which boron is either complexed by, or is the salt of, one or more nitrogen atoms of the basic nitrogen present in the succinimide. Consequently, in most cases the alkenyl succinimide will contain at most 6, but preferably 2 to 5 basic nitrogen atoms per molecule of succinimide.

The complex may be formed by reacting the borated glycerol ester and the succinimide together in the pure state, at a temperature above the melting point of the mixture of reactants and below the decomposition temperature, or in a diluent in which both reactants are soluble. For example, the reactants can be combined in the proper ratio in the absence of a solvent to form a homogenous product which may be added to the oil or the reactants can be combined in the proper ratio in a solvent such as toluene or chloroform, the solvent can be eliminated by stripping off, and the complex thus formed can be added to the oil. Alternatively, the complex can be prepared in a lubrication oil in the form of a concentrate containing from about 20 to 90% by weight of the complex, which concentrate can be added in appropriate quantities to the lubricating oil in which it is to be used or the complex may be prepared directly in the lubricating oil in which it is to be used.

The diluent is preferably inert vis-à-vis the reactants and the products formed and is used in a quantity sufficient to ensure solubility of the reactants and to allow the mixture to be efficiently stirred.

Temperatures for the preparation of the complex can be in the range of from 25° C. to 200° C. and preferably 25° C. to 100° C. as a function of whether the complex is prepared in the pure state or in a diluent, which signifies that lower temperatures can be used when a solvent is used.

In general, the complexes of the present invention can also be used in combination with other additive systems in standard quantities for their known purpose.

For example, for application in modern crankcase lubricants, the base composition described above is formulated with supplementary additives to provide the necessary stability, detergent, dispersant, anti-wear and anti-corrosion properties.

Thus, as another embodiment of this invention, the lubrication oils to which the complexes prepared by reacting the borated glycerol esters and the succinimides can be added can contain an alkali or alkaline earth metal phenate, and a Group II metal dihydrocarbyl dithiophosphate.

Also, since the succinimides act as excellent dispersants, additional succinimides can be added to the lubricating oil compositions, above the quantities added in the form of the complex with the borated glycerol esters. The quantity of succinimides can range up to about 20% by weight of the total lubricating oil compositions.

The alkali or alkaline earth metal hydrocarbyl sulphonates can consist of sulphonate derivatives of petroleum, synthetically alkylated aromatic sulphonates, or aliphatic sulphonates such as those derived from polyisobutylene. One of the most important functions of the sulphonates is to act as a detergent. The sulphonates are well known in the art. These hydrocarbyl groups must have a sufficient number of carbon atoms to render the sulphonate molecule soluble in the oil. Preferably, the hydrocarbyl portion has at least 20 carbon atoms and can be aromatic or aliphatic, but is usually alkylaromatic. Most preferred for use are calcium, magnesium, or barium sulphonates which are aromatic in character.

Certain sulphonates are typically prepared by the sulphonation of a petroleum fraction containing aromatic groups, usually mono- or dialkylbenzene groups, and then the formation of the metal salt of the sulphonic acid type material. Other feedstocks used for the preparation of these sulphonates include synthetically alkylated benzenes and aliphatic hydrocarbons prepared by the polymerization of a mono- or diolefin, for example, a polyisobutenyl group prepared by the polymerization of isobutene. The metallic salts are formed directly or by metathesis using well-known operating methods.

The sulphonates can be neutral or overbased. Carbon dioxide and calcium hydroxide or oxide are the most commonly used materials to produce the basic or overbased sulphonates. Mixtures of neutral and overbased sulphonates can be used. The sulphonates are usually used so as to represent from 0.3% to 10% by weight of the total composition. Preferably, the neutral sulphonates are present in a quantity from 0.4% to 5% by weight of the total composition and overbased sulphonates are present in a quantity from 0.3% to 33% by weight of the total composition.

The phenates intended for use in the present invention are standard products, which are the alkali or alkaline earth metal salts of alkylated phenols. One of the functions of the phenates is to act as a detergent. Among other things, the phenate prevents the deposit of contaminants formed during high temperature operation of the engine. The phenols can be mono- or polyalkylated.

The alkyl portion of the alkyl phenate is present to lend solubility to the phenate in the oil. The alkyl portion can be obtained from naturally occurring or synthetic sources. Naturally occurring sources include petroleum hydrocarbon derivatives such as white oil and wax. Being derived from petroleum, the hydrocarbon group consists of a mixture of different hydrocarbyl groups, the specific composition of which depends upon the particular oil stock that was used as a starting material. Suitable synthetic sources include various commercially available alkenes and alkane derivatives which, when reacted with the phenol, produce an alkylphenol. Suitable radicals obtained include butyl, etc. radicals. Other suitable synthetic sources of the alkyl radical include olefin polymers such as polypropylene, polybutylene, polyisobutylene etc.

The alkyl group can be straight-chained or branch-chained, saturated or unsaturated (if unsaturated, it preferably contains no more than 2 and generally no more than 1 site of olefinic unsaturation). The alkyl radicals generally contain from 4 to 30 carbon atoms. In general when the phenol is monoalkyl-substituted, the alkyl radical should contain at least 8 carbon atoms. The phenate can be sulphurized if desired. It can be either neutral or overbased and if it is overbased has a base number of 200 to 300 or more. Mixtures of neutral and overbased phenates can be used.

The phenates are usually present in the oil to represent from 0.2% to 27% by weight of the total composition. In an advantageous manner, the neutral phenates are present in a quantity from 0.2% to 9% by weight of the total composition and the overbased phenates are present in a quantity from 0.2% to 13% by weight of the total composition. Preferably, the overbased phenates are present in a quantity from 0.2% to 27% by weight of the total composition.

The preferred metals are calcium, magnesium, strontium and barium.

The sulphurized alkaline earth metal alkyl phenates are preferred. These salts are obtained by a variety of processes such as the treatment of the neutralization product of an alkaline earth metal base and an alkylphenol with sulfur.

Conveniently the sulfur, in elemental form, is added to the neutralization product and reacted at high temperatures in order to produce the sulfurized alkaline earth metal alkyl phenate.

If more of a quantity of base containing alkaline earth metal was added during the neutralization reaction than was necessary to neutralize the phenol, a basic sulphurized alkaline earth metal alkyl phenate is obtained. See, for example, the process of Walker et al., U.S. Pat. No. 2,680,096. Additional basicity can be obtained by adding carbon dioxide to the basic sulphurized alkaline earth metal alkyl phenate. The excess base containing an alkaline earth metal can be added after the sulphurization step but is conveniently added at the same time as the addition of the alkaline earth metal to neutralize the phenol.

Carbon dioxide and calcium hydroxide or oxide are the most commonly used substances to produce the basic or "overbased" phenates. A process in which basic sulphurized alkaline earth metal alkylphenates are produced by the addition of carbon dioxide is described by Hanneman in U.S. Pat. No. 3,178,368.

The Group II metal salts of dihydrocarbyl dithiophosphoric acids present anti-wear, antioxidant and thermal stability properties. Group II metal salts of phosphorodithioic acids have been described previously. See, for example, U.S. Pat. No. 3,390,080, columns 6 and 7, in which these compounds and their preparations are described in a general fashion. Suitably, the Group II metal salts of the dihydrocarbyl dithiophosphoric acids which are of use in the lubricationg oil composition of the present invention contain from about 4 to about 12 carbon atoms in each of the hydrocarbyl radicals and can be identical or different and can be aromatic, alkyl or cycloalkyl. The preferred hydrocarbyl groups are alkyl groups containing from 4 to 8 carbon atoms and are represented by butyl, isobutyl, sec-butyl, hexyl, isohexyl, octyl, 2-ethylhexyl etc. radicals. The metals suitable for the formation of these salts include barium, calcium, strontium, zinc and cadmium, amongst which zinc is preferred.

Preferably, the Group II metal salt of a dihydrocarbyl dithiophosphoric acid corresponds to the following formula:

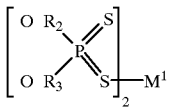

in which:

$R_2$ and $R_3$ each independently represent hydrocarbyl radicals corresponding to the description immediately above, and $M_1$ represents a Group II metal cation corresponding to the previous definition.

The dithiophosphoric salt is present in the lubricating oil compositions of the present invention in a quantity effective to inhibit wear and oxidation of the lubricating oil. The quantity ranges from about 0.1 to about 4% by weight of the total composition; preferably, the salt is present in a quantity representing about 0.2 to 2.5% by weight of the total lubricating oil composition. The final lubricating oil composition will usually contain from 0.025 to 0.25% by weight of phosphorus and preferably 0.05 to 0.1.5% by weight.

The finished lubricating oil can be single or multigrade. Multigrade lubricating oils are prepared by adding agents which improve the viscosity index (VI). Standard agents for improving the viscosity index are alkyl methacrylate polymers, ethylene-propylene copolymers, styrene-diene copolymers, etc. Agents called decorated VI improvers having both viscosity index and dispersion improvement properties are also suitable for use in the formulations of the present invention.

The lubricating oil used in the compositions of the present invention can be a mineral oil or a synthetic oil of lubricating viscosity, preferably suitable for use in the crankcase of an internal combustion engine. Crankcase lubricating oils usually have a viscosity of about 1300 cST at 0° F. (−18° C.) to 22.7 cSt at 210° F. (99° C.). The lubricating oils can be derived from synthetic or natural sources. The mineral oils intended to be used as the base oil in the present invention include paraffinic oils, naphthenic oils and other oils which are usually used in lubricating oil compositions. The synthetic oils include hydrocarbon synthetic oils and synthetic esters. Particularly useful synthetic hydrocarbon oils are liquid polymers of alpha olefins having the suitable viscosity. Particularly useful oils are hydrogenated liquid oligomers of $C_{6-12}$ alpha olefins such as 1-decene trimers, tetramers and higher oligomers. Similarly, alkyl benzenes of suitable viscosity, such as didodecyl benzene can be used. Useful synthetic esters include the esters of a monocarboxylic acid and polycarboxylic acids as well as monohydroxy alkanols and polyols. Typical examples are didoceyl adipate, pentaerythritol tetracaproate, di-2-ethylhexyl adipate, dilauryl sebacate, etc. Complex esters prepared from mixtures of mono- and dicarboxylic acid and mono- and dihydroxy alkanols can also be used.

Blends of hydrocarbon oils with synthetic oils are also useful. For example, blends of 10 to 25% by weight of a hydrogenated 1-decene trimer with 75 to 90% by weight of a mineral oil having a viscosity of 33 cSt at 100° F. (38° C.) give an excellent lubricating oil base.

Other additives which may be present in the formulation include rust removing additives, foam inhibitors, corrosion inhibitors, metal deactivators, pour point depressants, antioxidants and a variety of other well-known additives.

The following examples are proposed to specifically illustrate the present invention. These examples and illustrations are not to be considered in any way as limiting the scope of the present invention.

EXAMPLES

The invention will be further illustrated by following examples, which set forth particularly advantageous method embodiments. While the Examples are provided to illustrate the present invention, they are not intended to limit it.

TESTING PROCEDURE

The envisaged additives were tested for their compatibility in a bench test (PV 3344) by suspending a fluorocarbon test piece (AK 6) in an oil-based solution heated to 150° C. for 282 hours, the oil being renewed every 92 hours, then by measuring the variation in the physical properties of the sample, in particular the tensile strength break (TSB) and the elongation at break (ELB), in accordance with procedure DIN 53504, by observing whether any cracks had formed at 100% elongation. The passing test criteria included the following: no evidence of crack development; a tensile strength break greater than 8N/mm2 and an elongation at break greater than 160%. This test procedure will be designated above and later simply as the "VW Bench Test".

Two baseline formulations, additives A and B were used in these tests.

Additive A is a detergent-inhibitor for petrol and diesel passenger vehicles. It contains a polyisobutene bis-succinimide the PIB molecular weight of which is 2200 $gmol^{-1}$ having been subjected to a treatment with ethylene carbonate, a polyisobutene dispersant ester of which the PIB molecular weight is 950 $gmol^{-1}$, a sulphurized calcium alkylate-phenate, a calcium alkylsulphonate LOB, a secondary zinc dithiophosphate, a magnesium alkylsulphonate HOB, an amino oxidation inhibitor, a phenolic oxidation inhibitor and a foam inhibitor.

Additive B is a detergent-inhibitor formulation for diesel commercial vehicles. It contains practically the same components as additive A but in different proportions. It contains no polyisobutene dispersant ester, nor a phenolic oxidation inhibitor. In addition, it contains a specific molybdenum-based anti-wear additiive.

Tests were carried out in additive B by replacing the polyisobutene bis-succinimide having been subjected to ethylene carbonate treatment by a the polyisobutene bis-succinimide with the same molecular weight but not having been subjected to ethylene carbonate treatment.

The finished oil formulated from these additives contains an olefin copolymer as a viscosity index improver and a blend of mineral oils of ESSO 150N and 600N grades.

TESTS

A series of experiments was carried out in order to determine the concentration of borated glycerol monooleates required in additives containing a bis-succinimide, having been subjected to post-treatment or not, with ethylene carbonate in order to produce a satisfactory result in the PV 3344 bench test. The borated glycerol monooleate was at concentrations such that the % boron/% basic nitrogen ratio varies over the range of approximately 0.5 to 4.0. The results are summarized in the table below.

Formulation I: Additive A plus a bis-succinimide having a molar ratio of polyalkylene amine/PIBSA of 0.44, wherein the bis-succinimide was treated with ethylene carbonate.

Formulation II: Additive B plus a bis-succinimide having a molar ratio of polyalkylene amine/PIBSA of 0.44, wherein the bis-succinimide was treated with ethylene carbonate.

Formulation III: Additive A plus an untreated bis-succinimide having a molar ratio of polyalkylene amine/PIBSA of 0.44.

| % Boron/ % basic N in oil | Formulation I | Formulation II | Formulation III |
|---|---|---|---|
| 0.58 | TSB: 9.7<br>ELB: 207<br>cracks: yes | | |
| 0.63 | | TSB: 9<br>ELB: 172<br>cracks: yes | |
| 0.94 | | TSB: 9.4<br>ELB: 180<br>cracks: yes | |
| 1.14 | TSB: 10.2<br>ELB: 214<br>cracks: no | | |
| 1.26 | | TSB: 9.9<br>ELB: 184<br>cracks: no | |
| 2.08 | | | TSB: 8.1<br>ELB: 186<br>cracks: yes |
| 2.50 | | | TSB: 82<br>ELB: 2192<br>a few cracks |
| 3.3 | | | TSB: 8.3<br>ELB: 188<br>cracks: no |

These results show that post-treatment of dispersants commonly found in oil additives, such as succinimides, allows a reduction in the quantity of borated glycerol oleates required to eliminate the presence of cracks on fluorocarbon elastomers. For succinimides which have been subjected to a post-treatment, the minimum % boron/% basic nitrogen ratio is equal to approximately 1.0, whereas for succinimides which have not been subjected to a post-treatment, this same minimum ratio is probably around 3.

While the present invention has been described with reference to specific embodiments, this application is intended to cover those various changes and substitutions that may be made by those skilled in the art without departing from the spirit and scope of the appended claims.

What is claimed is:

1. A process for improving the compatibility of a lubricating oil composition, comprising at least one dispersant containing basic nitrogen atoms, with fluorocarbon elastomers, said method comprising adding an effective quantity of borated compounds having the following general formula (I):

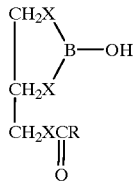

in which X is S or O, and R is a hydrocarbyl group containing at least 3 carbon atoms, wherein said dispersant is a bis-succinimide, and wherein:

(a) when the bis-succinimide is post-treated with ethylene carbonate, the minimum ratio %Boron/% basic N of the lubricating oil composition is situated around 1.0, and (b) when the bis-succinimide is not subjected to a post-treatment step, the minimum ratio %Boron/% basic N of the lubricating oil composition is situated around 3.0.

2. A process for improving the compatibility of a lubricating oil composition according to claim 1 wherein R is a hydrocarbyl group containing between 3 and 50 carbon atoms.

3. A process for improving the compatibility of a lubricating oil composition according to claim 1 wherein R is a hydrocarbyl group containing between 3 and 17 carbon atoms.

4. A process for improving the compatibility of a lubricating oil composition according to claim 1 wherein the compound of general formula (I) is borated glycerol monooleate.

* * * * *